US006640399B2

(12) United States Patent
Perez Romo

(10) Patent No.: US 6,640,399 B2
(45) Date of Patent: Nov. 4, 2003

(54) FASTENER CLIP, PLIERS AND METHOD OF USE

(76) Inventor: Carlos M. Perez Romo, Bosque de Versalles #31, Colinas del Bosque 2A Seccion Villa Corregidora Queretoro QR 76090 (MX)

( * ) Notice: Subject to any disclaimer, the term of this patent is extended or adjusted under 35 U.S.C. 154(b) by 0 days.

(21) Appl. No.: 09/780,018

(22) Filed: Feb. 9, 2001

(65) Prior Publication Data

US 2001/0023626 A1 Sep. 27, 2001

Related U.S. Application Data

(63) Continuation-in-part of application No. 09/504,458, filed on Feb. 16, 2000.

(51) Int. Cl.[7] ..... A44B 21/00
(52) U.S. Cl. ..... 24/570; 24/455; 24/16 R
(58) Field of Search ..... 24/455, 456, 488, 24/530, 545, 546, 570, 571, 16 R

(56) References Cited

U.S. PATENT DOCUMENTS

| | | | | | |
|---|---|---|---|---|---|
| 601,506 | A | | 3/1898 | Eames | |
| 1,064,404 | A | | 6/1913 | Walker | |
| 1,095,054 | A | | 4/1914 | Wiesenfeld | |
| 1,141,916 | A | | 6/1915 | Aderer | |
| 1,465,429 | A | | 8/1923 | Gasparaitis | |
| 1,637,742 | A | | 8/1927 | Edge et al. | |
| 1,816,833 | A | | 8/1931 | Ehlers | |
| D90,137 | S | | 6/1933 | Gutsche | |
| 2,055,257 | A | | 9/1936 | Maynard et al. | |
| 2,174,152 | A | | 9/1939 | Curtiss | |
| 2,678,443 | A | | 5/1954 | Lindstrom | |
| 2,730,718 | A | | 1/1956 | Macy | |
| 2,921,315 | A | | 1/1960 | Albrecht et al. | |
| 3,234,616 | A | * | 2/1966 | Wantland | 24/546 |
| 3,331,179 | A | | 7/1967 | Ernst et al. | |
| 3,505,709 | A | * | 4/1970 | Tirone | 24/546 |
| 3,628,230 | A | | 12/1971 | Grise | |
| 4,201,215 | A | * | 5/1980 | Crossett et al. | 24/546 |
| 4,847,957 | A | * | 7/1989 | Ranta | 24/546 |
| 4,951,361 | A | * | 8/1990 | Stephens, Jr. | 24/546 |
| 5,022,292 | A | | 6/1991 | Hammer et al. | |
| 5,035,040 | A | | 7/1991 | Kerrigan et al. | |
| 5,054,226 | A | | 10/1991 | Hart | |
| 5,123,273 | A | | 6/1992 | Kawabata | |
| 5,309,604 | A | * | 5/1994 | Poulsen | 24/16 R |
| 5,483,815 | A | | 1/1996 | West | |
| 5,881,452 | A | | 3/1999 | Nowell, III et al. | |
| 5,881,460 | A | | 3/1999 | Nowell, III et al. | |
| 5,938,099 | A | | 8/1999 | Ciccarelli | |
| 5,979,021 | A | * | 11/1999 | Swift | 24/546 |
| 6,035,508 | A | | 3/2000 | Smith | |

* cited by examiner

*Primary Examiner*—James G. Smith
(74) *Attorney, Agent, or Firm*—Andy Arismendi, Jr.

(57) ABSTRACT

A hand held and operated set of fastener clip pliers is provided which is useful to secure together reinforcement steel members, for example, those used in concrete construction, upholstery and fencing. The fastener clip pliers are comprised of a lower handle and an upper handle. The lower handle has at least two first prongs that define at least one intermediate slot between. The upper handle is pivotally connected to the lower handle such that the upper handle and lower handle can pivot to an open position and to a closed position. The upper handle has at least one second prong dimension to fit within an intermediate slot in the closed position. A fastening clip is provided that has a small extension protruding therefrom for manipulating and properly placing the fastening clip around the steel members prior to securing the fastening clip to the steel members.

12 Claims, 8 Drawing Sheets

FASTENER CLIP, PLIERS AND METHOD OF USE

RELATED APPLICATIONS

This is a continuation-in-part of application Ser. No. 09/504,458, filed Feb. 16, 2000.

FIELD OF THE INVENTION

The present invention relates to a hand held and operated set of fastener clip pliers, fastening clips and their method of use. More specifically, the present invention relates to a hand held and operated set of fastener clip pliers and fastening clips useful to secure together reinforcement steel members, for example, those used in concrete construction.

BACKGROUND OF THE INVENTION

In order to enhance the strength of concrete used for pipe, drainage structures, building structures, bridge beams, concrete highways and so forth, the concrete is typically reinforced with a latticework of rebar or wire mesh steel in single or multiple layers. The rebar or wire is typically laid out in a grid-like pattern or framework in a concrete form and secured together loosely using wire ties. The ties hold the reinforcement steel in place while the concrete is being poured around it. After the concrete sets, the reinforcement steel members become permanently positioned within the concrete.

Most reinforcement steel members used in commercial concrete construction have been tied together in the same way for many years. The wire ties, typically comprising very light gage, mild steel wire supplied on a belt-mounted reel, are pulled off the belt-mounted reel, wrapped around the reinforcement steel members, pulled taut with conventional side cutters or pliers, twisted, and cut. This conventional method of tying together reinforcement members is very labor intensive and adds considerable costs to concrete construction jobs. Further, the difficulty associated with the conventional method has often resulted in the reinforcement members being tied defectively, resulting in weak points within the structure.

Several clips have been developed for use in concrete construction to overcome the disadvantages of conventional manually applied ties. For example, U.S. Pat. No. 3,331,179 discloses manufactured spacer rings intended to ease the process of securing reinforcement steel members together during concrete construction. The manufactured spacer rings secure a grid of reinforcement steel members at the intersection points of the reinforcement steel rods. The manufactured spacer rings are formed with a split for spreading the rings to facilitate mounting over the reinforcement steel rods. After the ring is mounted, release of the spread ring results in the ring closing upon the rods due to the elasticity of the material.

While effective, the manufactured spacer rings disclosed in U.S. Pat. No. 3,331,179 are expensive to manufacture. The spacer rings require a relatively large amount of spring steel material to perform the intended function of spacing the grid away from the bottom surface of the concrete form and yet provide the elasticity to reclose the ring upon the rods after the ring is spread to mount the ring over the rods. Moreover, such manufactured spacer rings are inefficient to use because they require a rather difficult and tedious process of spreading the rings during installation.

U.S. Pat. Nos. 5,881,452 and 5,938,099 each disclose an apparatus for tying fasteners suitable for use in concrete construction. The '452 patent discloses a hand held apparatus that is powered by pneumatic pressure supplied by a compressed air force. Similarly, the '099 patent discloses a hand held machine that uses power from outside sources instead of manual power. Thus, each device has the inherent disadvantages of increased cost and limited mobility associated with externally powered devices.

Similar tying devices have been utilized in conjunction with hog rings. For example, U.S. Pat. Nos. 3,628,230, 5,035,040, and 5,123,273 each disclose a hand held, air-powered tool for applying hog rings for use in conventional applications. These prior art tools each utilize a complex mechanical linkage and jaw arrangement for deforming the hog rings, which are fed in one-at-a-time from a magazine. Additionally, U.S. Pat. No. 5,483,815, utilizes a rather complex and inefficient series of cams and jaws retained together by a neoprene O-ring. However, hog rings and similar fasteners have not previously been used in conjunction with the construction industry to secure reinforcement members. Conventional hog rings are too small for this purpose and have not heretofore been recognized as a possible solution to the high labor costs associated with concrete construction. Moreover, prior art devices used to apply hog rings and similar fasteners have disadvantages that make the devices expensive and inefficient to manufacture. The disadvantages of each of the aforementioned applicator tools are further exaggerated when used to apply the larger fastener clips associated with concrete construction.

There exists, therefore, a need for a hand held apparatus for tying fasteners for use in concrete construction that efficiently secures reinforced members while retaining the low costs associated with the use of manual power.

SUMMARY OF THE INVENTION

The present invention relates to a hand held and operated set of fastener clip pliers useful to secure together reinforcement steel members. The steel or metal members may be those used in concrete construction, upholstery and fencing. In a preferred embodiment of the present invention, the fastener clip pliers are comprised of a lower handle and an upper handle. The lower handle has at least two first prongs which define at least one intermediate slot between. The upper handle is pivotally connected to the lower handle such that the upper handle and lower handle can pivot to an open position and to a closed position. The upper handle has at least one second prong dimension to fit within an intermediate slot in the closed position. The tying or securing of the fastening clips using the fastener clip pliers involves having one of each of the at least two first prongs and at least one second prong engage a fastening clip placed around the steel members while the upper and lower handles are in the open position and then pivoting the upper and lower handles toward the closed position to effect closing of the fastening clip around the steel members.

In another preferred embodiment of the fastener clip pliers of the present invention, the fastener clip pliers are again comprised of a lower handle and an upper handle. The lower handle has a first tying end and a first manipulation end. The first tying end further has at least two first prongs and a first securing means. The first prongs define at least one intermediate slot therebetween and are inwardly curved to facilitate tying of the fastening clips to the steel members. The upper handle has a second tying end and a second manipulation end. The second tying end further has a second securing means and at least one second prong. The second securing means is pivotally connected to the first securing means of the lower handle such that the upper handle and lower handle can pivot around the axis of the first securing means and the axis of the second securing means to a closed position and to an open position. The second prong is dimensioned to fit within the an intermediate slot in the closed position and is inwardly curved to facilitate tying of the fastening clips to the steel members. The first manipulation end is preferably fitted with an upper grip or defines a finger receptacle for manipulation of the lower handle. The second manipulation end is preferably fitted with a lower grip or defines a thumb receptacle for manipulation of the upper handle. The securing of the fastening clips using the fastener clip pliers involves having one of each of the at least two first prongs and at least one second prong engage a fastening clip placed around the steel members while the upper and lower handles are in the open position and then pivoting the upper and lower handles toward the closed position to effect closing of the fastening clip around the steel members.

Yet another preferred embodiment of the present invention provides a fastening clip for securing together reinforcement steel members, for example, those used in concrete construction, upholstery and fencing. The fastening clip is comprised of a first leg connected to a second leg by a body portion. The fastening clip further comprises a small extension protruding from the body portion or one of the legs for placing the fastening clip around the reinforcement steel members.

Still another preferred embodiment of the present invention provides a fastening clip for securing together reinforcement steel members, for example, those used in concrete construction, upholstery and fencing. The fastening clip is comprised of a first leg, a second leg, a body portion, and a small extension. The first leg has a first end and is curved inwardly along its length to facilitate securing of the fastening clip over the reinforcement steel members, and a second leg connected by a body portion. The second leg has a second end and is curved inwardly along its length to facilitate securing of the fastening clip over the reinforcement steel members. The body portion connects the first leg to the second leg such that the first leg and second leg are bent away in opposite directions from a plane parallel with the body portion to prevent the first and second ends from abutting when the fastening clip is secured over the reinforcement steel members. The small extension protrudes from the body portion or one of the legs for placing the fastening clip around the reinforcement steel members.

Another preferred embodiment of the present invention provides a method of using the fastener clip pliers to secure together at least two reinforcement steel members with a fastening clip. The fastening clip used in the method comprises a first leg, a second leg, a body portion connecting the first leg to the second leg, and a small extension protruding from the body portion or one of the legs. In the method, the small extension of the fastening clip is used to position the fastening clip around at least two reinforcement steel members to be secured. The fastening clip is held in position while placing the fastener clip pliers around the fastening clip such that the first leg of the fastening clip is in alignment with any of the first prongs and the second leg of the fastening clip is in alignment with at least one second prong. The lower handle and the upper handle are pivoted such that the first leg and the second leg of the fastening clip are engaged by one of the two first prongs and at least one second prong. The pivoting of the handles is continued until the at least one second prong is forced into the at least one intermediate slot defined by the first prongs and the fastening clip is secured around the reinforcement members in an overlapping fashion.

Other objects, and the advantages, of the present invention will be made clear to those skilled in the art by the following detailed description of the preferred embodiments constructed in accordance with the teachings of the present invention.

BRIEF DESCRIPTION OF THE DRAWINGS

FIG. 11 is an end view of the bifurcated prongs and the unitary prong with a fastening clip located between.

DETAILED DESCRIPTION OF THE PREFERRED EMBODIMENT

In the following detailed description of the preferred embodiments of the fastener clip pliers, the invention is described as being used to secure steel reinforcement members together using fastener clips during concrete construction. The present invention is not, however, restricted to such concrete construction applications. Those skilled in the art will recognize that the present invention may be used to advantage for any number of fastening needs such as for upholstery and fencing. Further, the present invention is described as utilizing the associated fastener clips. Again, the present invention is not restricted to utilizing the described clips. Those skilled in the art will recognize that the present invention may be used to advantage with any number of fastening clips such as prior art hog clips or clips used in machine driven applicators. However, for purposes of illustration and not limitation, the present invention will be described with reference to concrete construction use.

Figure 1:
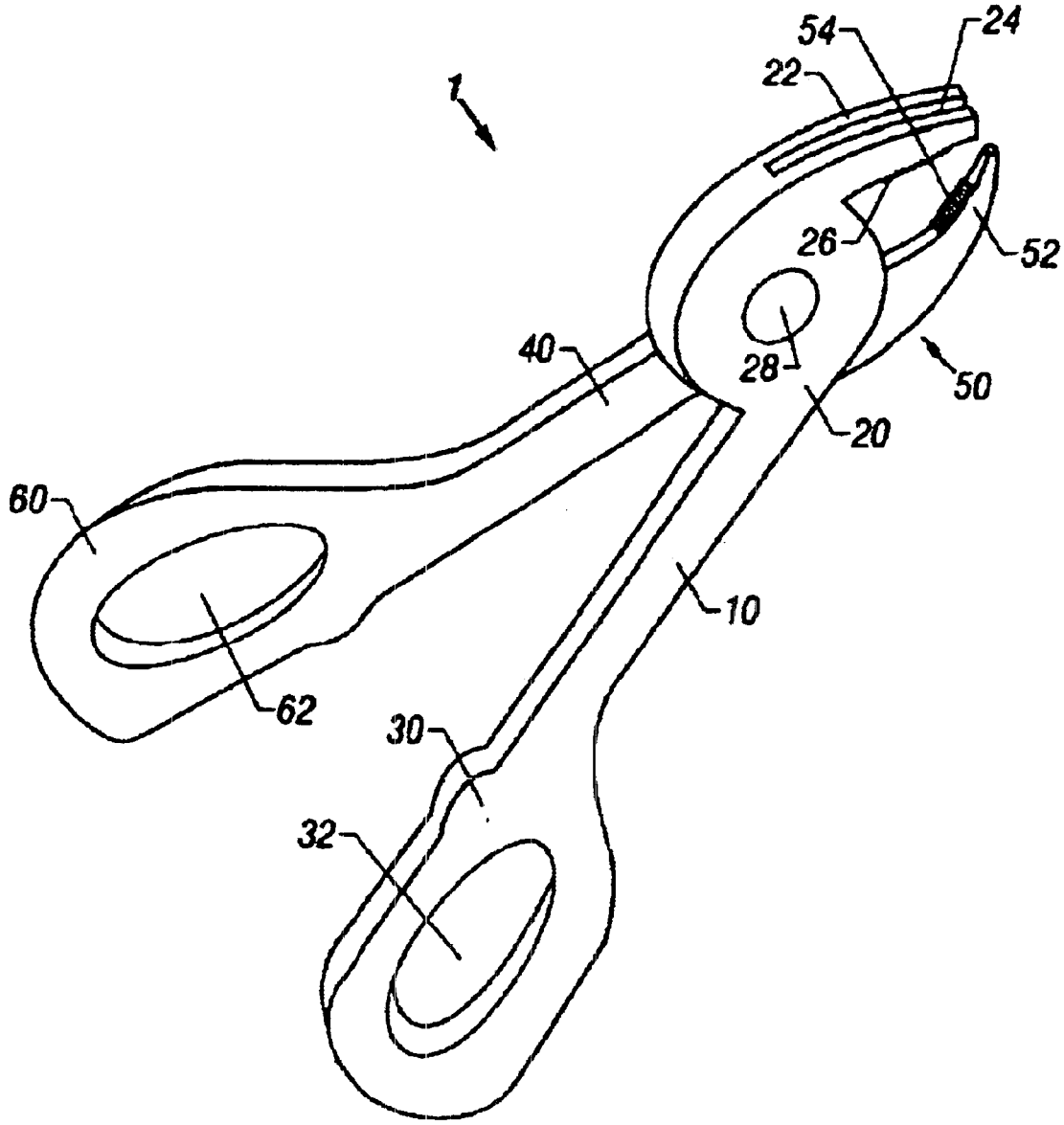
FIG. 1 is a perspective view of a preferred embodiment of the fastener clip pliers with the lower handle in the foreground.
Figure 2:
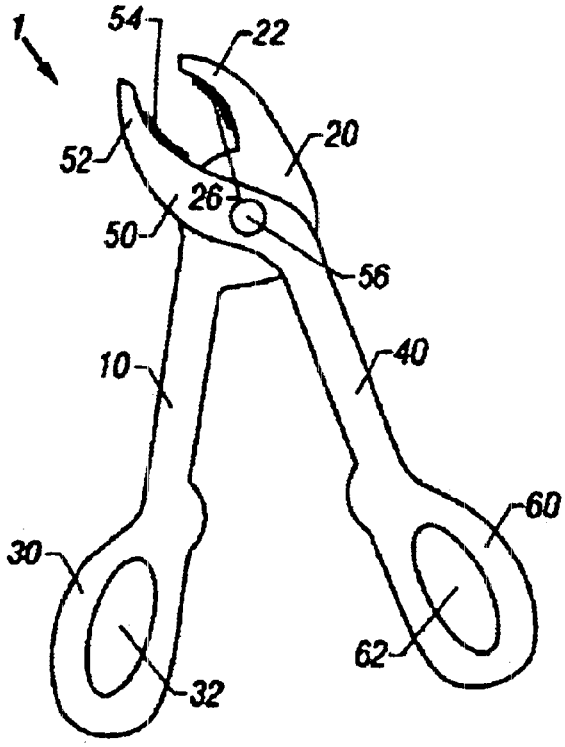
FIG. 2 is a side view of a preferred embodiment of the fastener clip pliers with the upper handle in the foreground.

FIGS. 1 and 2 illustrate a preferred embodiment of the fastener clip pliers (indicated generally as 1) of the present invention. FIG. 1 is a perspective view with the lower handle 10 in the foreground, and FIG. 2 is a side view with the upper handle 40 in the foreground. The fastener clip pliers 1 of a preferred embodiment are comprised of a lower handle 10 pivotally connected to an upper handle 40.

The lower handle 10 of a preferred embodiment of the present invention has a tying end 20 and a manipulation end 30. The tying end 20 further has two first prongs 22 and a securing means 28. The first prongs 22 are located along the tying end 20 and define an intermediate slot 24. The first prongs 22 are inwardly curved to facilitate tying of the fastening clips. Further, a series of grooves 26 are located along the first prongs to provide a gripping surface for manipulation of the fastening clips. The securing means 28 is used to pivotally connect the lower handle 10 to the upper handle 40. One skilled in the art will recognize that the securing means 28 can be any connection (such as a pin) which secures the lower handle 10 to the upper handle 40 while enabling the two handles 10 and 40 to pivot around the axis of the securing means 28 to a closed position and to an open position.

The manipulation end 30 of the lower handle 10 of a preferred embodiment of the present invention defines a finger receptacle 32. The finger receptacle 32 is used in a similar fashion as the finger receptacles on a pair of conventional scissors (i.e., the user's forefinger is inserted therein for manipulation of the lower handle 10). It should be noted that although the finger receptacle 32 is described as being manipulated by a forefinger, any and all fingers could be used to achieve the same result. Further, one skilled in the art would recognize that in certain circumstances the entire assembly of the fastener clip pliers 1 could be turned upside down enabling manipulation of the finger receptacle 32 by the user's thumb.

The upper handle 40 (as best shown in FIG. 2) of a preferred embodiment of the present invention has a tying end 50 and a manipulation end 60. The tying end 50 further has a securing means 56 and a second prong 52. The securing means 56 is used in conjunction with the securing means 28 of the lower handle 10 to pivotally connect the lower handle 10 to the upper handle 40 such that the lower handle 10 and the upper handle 40 can pivot around the axis of the securing means 28 and 56 to a closed position and to an open position. The second prong 52 is inwardly curved to facilitate tying of the fastening clips. Further, a series of grooves 54 are located along the second prong to provide a gripping surface for manipulation of the fastening clips. The second prong 52 is dimensioned to fit within the intermediate slot 24 in a closed position.

The manipulation end 60 of the upper handle 40 of a preferred embodiment of the present invention defines a thumb receptacle 62. The thumb receptacle 62 is used in a similar fashion as the thumb receptacles on a pair of conventional scissors (i.e., the user's thumb is inserted therein for manipulation of the upper handle 40). It should be noted that although the thumb receptacle 62 is described as being manipulated by a thumb, one skilled in the art would recognize that in certain circumstances the entire assembly of the fastener clip pliers 1 could be turned upside down enabling manipulation by the user's fingers.

It should be noted that one skilled in the art will recognize that the individual components associated with the lower handle 10 and the upper handle 40 may be reversed and still fall within the purview of the invention. For example, although in a preferred embodiment, the intermediate slot 24 is located on the lower handle 10 and the associated second prong 52 is located on the upper handle 40, one skilled in the art will recognize that relocating the second prong 52 to the lower handle 10 and relocating the intermediate slot 24 to the upper handle 40 is a change intended to fall within the scope of the invention.

Figure 1A:
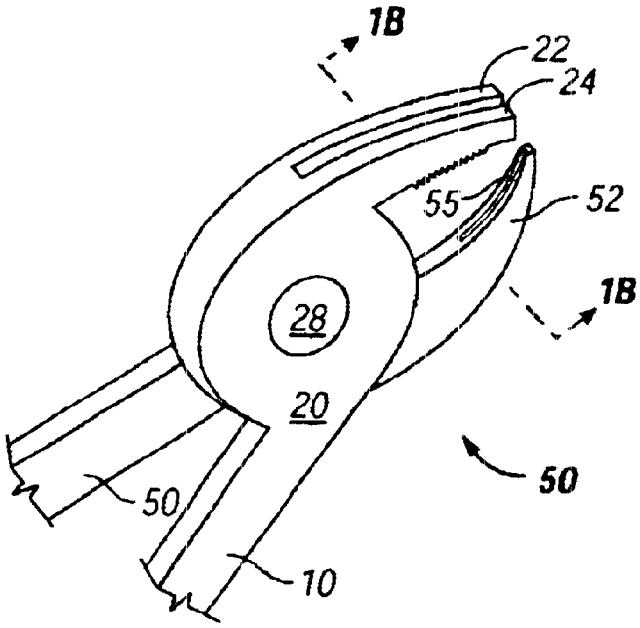
FIG. 1A is a perspective view of the tying end of another preferred embodiment of the fastener clip pliers.
Figure 1B:
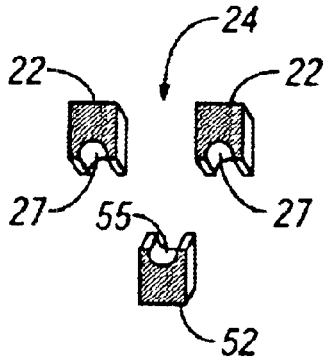
FIG. 1B is a cross-section of the embodiment shown in FIG. 1A along line 1B—1B.
Figure 1C:
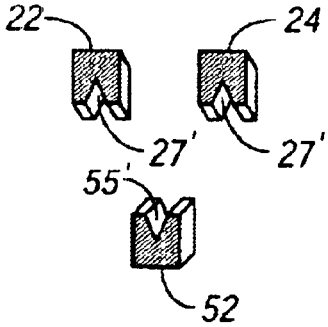
FIG. 1C is a cross-section of the prongs of the tying end of another preferred embodiment of the fastener clip pliers.

FIG. 1A illustrates another preferred embodiment of the fastener clip pliers, particularly in regards to the two first prongs and the second prong. As shown in FIG. 1, the series of grooves 26 and 54 are oriented substantially perpendicular to the length of first two prongs 22 and the second prong 52. In FIGS. 1A and 1B, there is instead shown a groove 27 running length-wise in each of the first two prongs 26 and a groove 55 running length-wise in the second prong 54. These grooves may be U-shaped as shown in FIG. 1B as grooves 27 and 55 or V-shaped as shown in FIG. 1C as grooves 27' and 55'. These grooves provide a stabilizing surface for manipulation of the fastening clips and tying or closing such clips around steel members.

Figure 3:
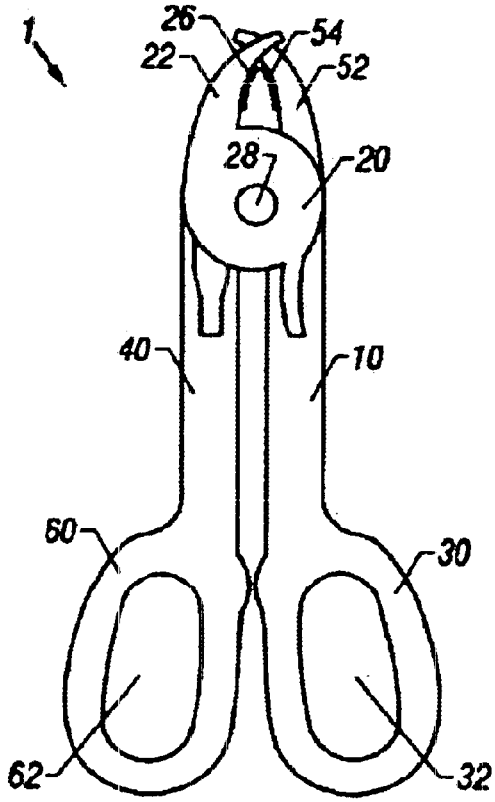
FIG. 3 is a side view of a preferred embodiment of the fastener clip pliers in its closed position.

FIG. 3 illustrates a preferred embodiment of the fastener clip pliers 1 in a closed position. The lower handle 10 and the upper handle 40 have been pivoted such that the second prong 52 of the upper handle 40 is positioned within the intermediate slot 24 of the lower handle 10.

Figure 4:
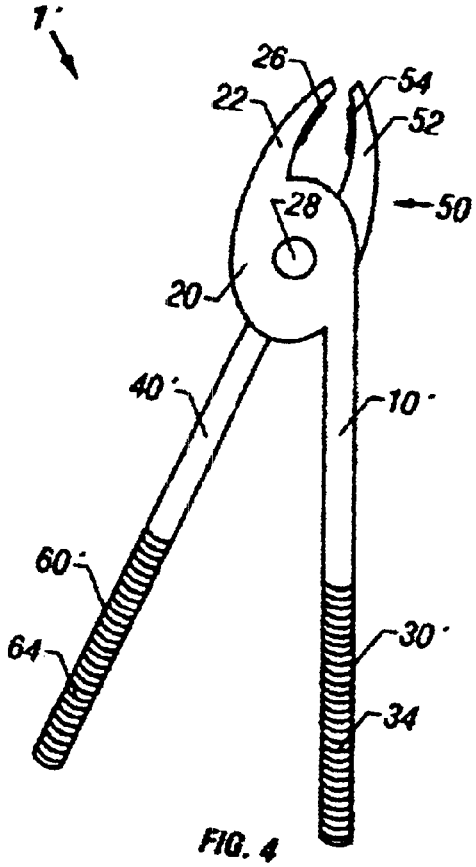
FIG. 4 is side view of an alternate preferred embodiment of the fastener clip pliers with a grip on the handles.

FIG. 4 illustrates another preferred embodiment of the fastener clip pliers 1'. In this preferred embodiment, the manipulation end 30' of the lower handle 10' does not define a receptacle. Rather, the manipulation end 30' is fitted with a lower grip 34 or is provided with a friction surface. Likewise, the manipulation end 60' of the upper handle 40' is fitted with an upper grip 64 or provided with a friction surface. Rather than being manipulated similar to a pair of scissors, this preferred embodiment of the fastener clip pliers 1 is manipulated similar to a conventional set of pliers.

Figure 5:
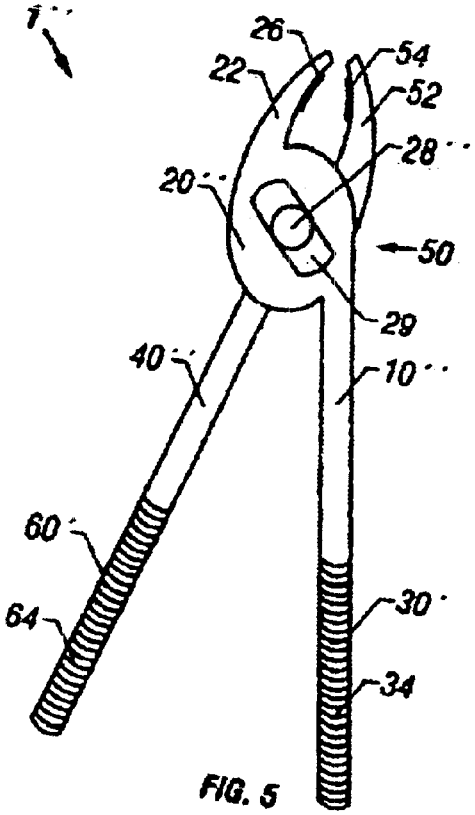
FIG. 5 is side view of an alternate preferred embodiment of the fastener clip pliers with an adjustment slot.

FIG. 5 illustrates yet another preferred embodiment of the fastener clip pliers 1". In this preferred embodiment, the tying end 20" of the lower handle 10" further defines a channel 29. The securing means 28" of the lower handle 10" is again pivotally connected to the securing means 56" of the upper handle 40", but is now slidably connected within the channel 29. The ability of the securing means 28" to slide within the channel 29 enables the fastener clip pliers 1" to accommodate a wider variety of sizes of fastening clips. Sliding the securing means 28" within the channel 29 adjusts the distance between the first prongs 22 of the lower handle 10" and the second prong 52 of the upper handle 40".

It should be noted, that although the figures illustrating the fastening clip pliers as having two first prongs 22 defining a single intermediate slot 24 and a single second prong 52, one skilled in the art will recognize that any number of prongs could be utilized and remain within the purview of the invention. It is only necessary that there be at least two first prongs 22 such that at least one intermediate slot 24 is defined to interact with at least one second prong 52.

Figure 6:
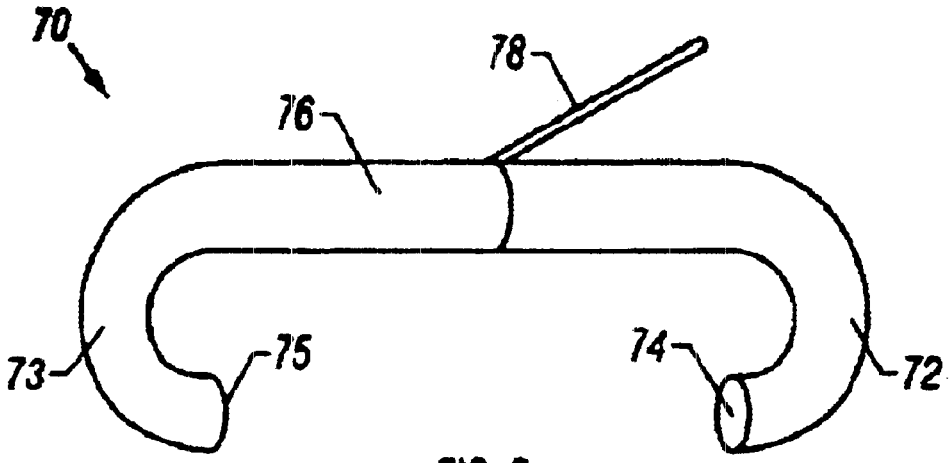
FIG. 6 is a side perspective view of a preferred embodiment of the fastener clips of the present invention in an open position.
Figure 7:
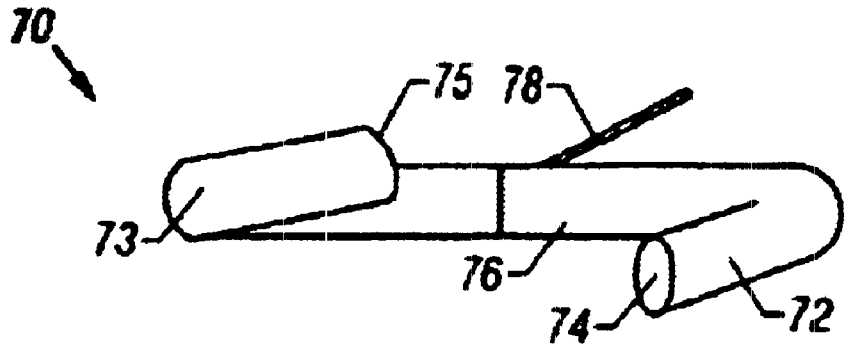
FIG. 7 is a top perspective view of a preferred embodiment of the fastener clips of the present invention in an open position.
Figure 8:
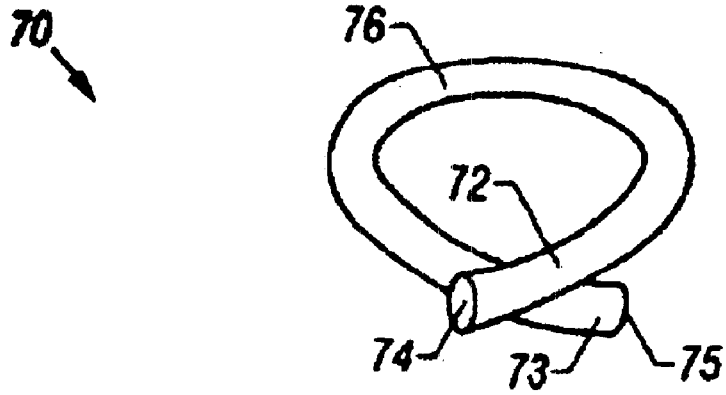
FIG. 8 is a side perspective view of a preferred embodiment of the fastener clips of the present invention in a closed position.

FIGS. 6–8 illustrate a preferred embodiment of the fastening clips (indicated generally as 70) of the present invention. As shown in FIG. 6, the fastening clips 70 of the present invention are generally C-shaped with an open end prior to being secured around the reinforcement steel members. The fastening clips 70 are comprised of first and second legs 72, 73, with respective first and second ends 74, 75. The first and second legs 72, 73 are curved inwardly along their length to facilitate closing the fastening clips 70 over the reinforcement members. The first and second legs 72 and 73 are connected by a body portion 76. Located along the body portion 76 protrudes a small extension 78 which enables gripping of the fastening clips 70 for manipulation of the fastening clips 70 into proper position around the reinforcement members.

As best shown in FIG. 7, the first and second legs 72, 73 are bent away in opposite directions from a plane parallel with the body portion 76 in order to prevent the ends 74, 75 of the legs 72, 73 from abutting and interfering with each other when the fastening clips 70 are forced into a closed position. In a closed position, shown in FIG. 8, the ends 74, 75 are not abutting, but rather the legs 72, 73 overlap and remain beside each other in a parallel fashion. The overlapping of the legs 72, 73 better secures the fastening clips 70 around the reinforcement members.

Figure 6A:
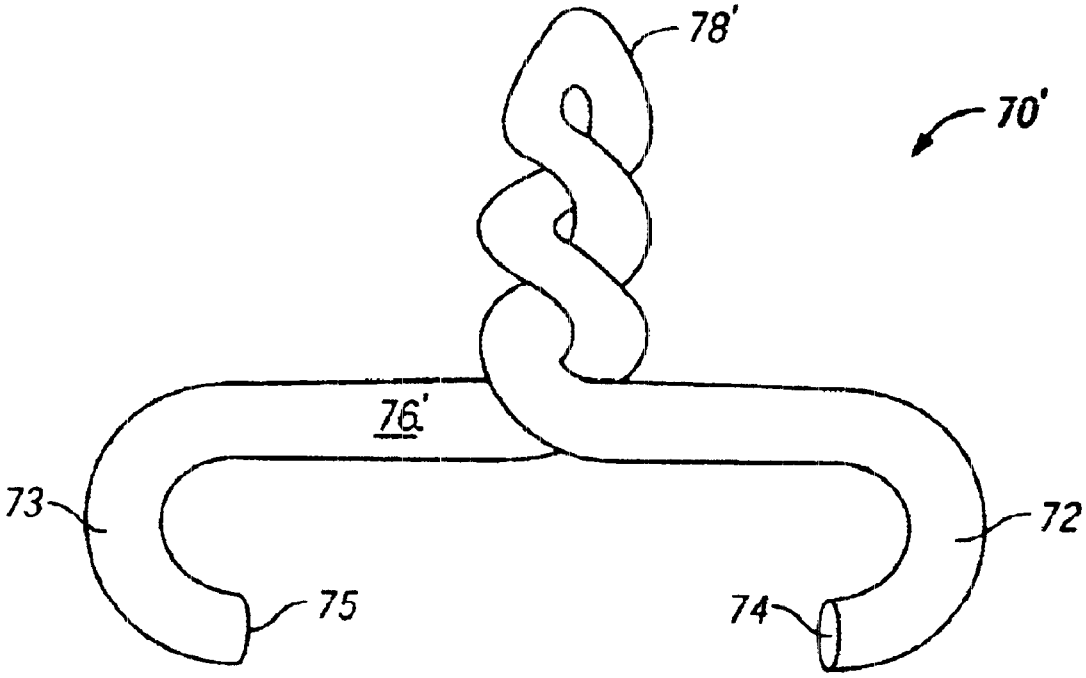
FIG. 6A is a side perspective view of another preferred embodiment of the fastener clips of the present invention in an open position.

FIG. 6A illustrates another preferred embodiment of the fastening clip (indicated generally by 70'). In this embodiment, the small extension is formed by twisting a portion of the body portion 76'.

Figure 9:
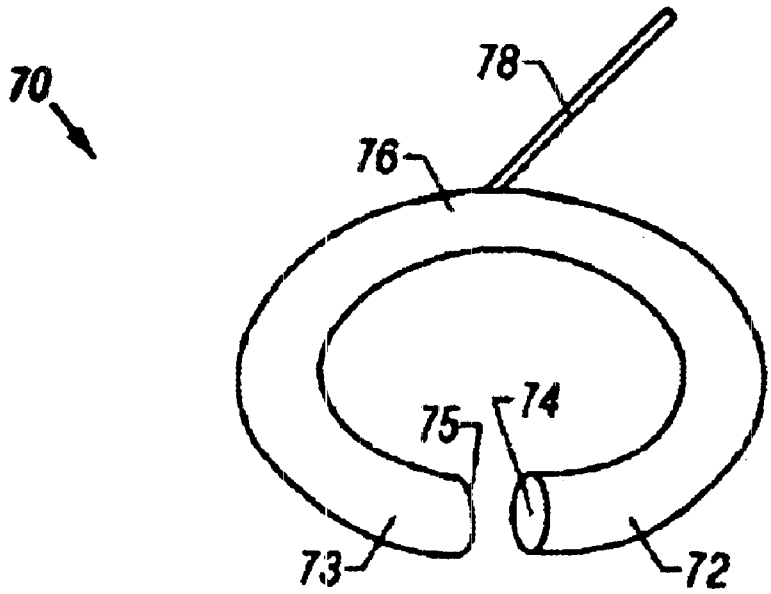
FIG. 9 is a side perspective view of an alternate preferred embodiment of the fastener clips of the present invention in an open position.

It should be noted that while a preferred embodiment of the present invention utilizes C-shaped fastening clips 70, other shapes of fastening clips 70, such as U-shaped, still remain within the purview of the invention. For example, in another preferred embodiment of the fastening clips 70, shown in FIG. 9, the fastening clips 70 are loop shaped. The loop shape is more suitable for use, for example, as a hog tie.

Figure 9A:
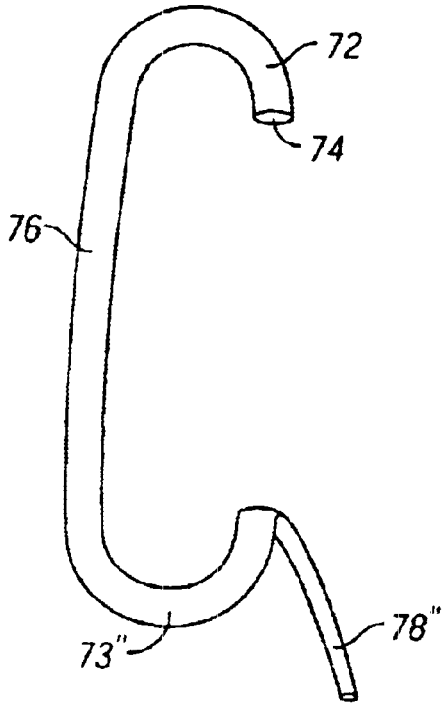
FIGS. 9A, 9B and 9C are side perspective views of other preferred embodiments of the fastener clips of the present invention in an open position
Figure 9B:
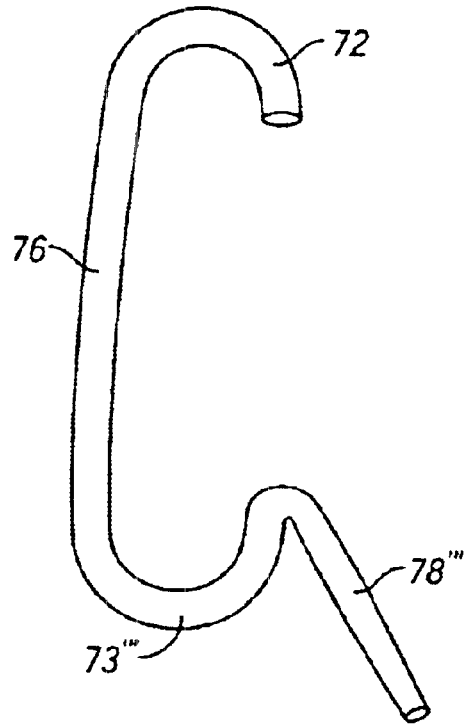
Figure 9C:
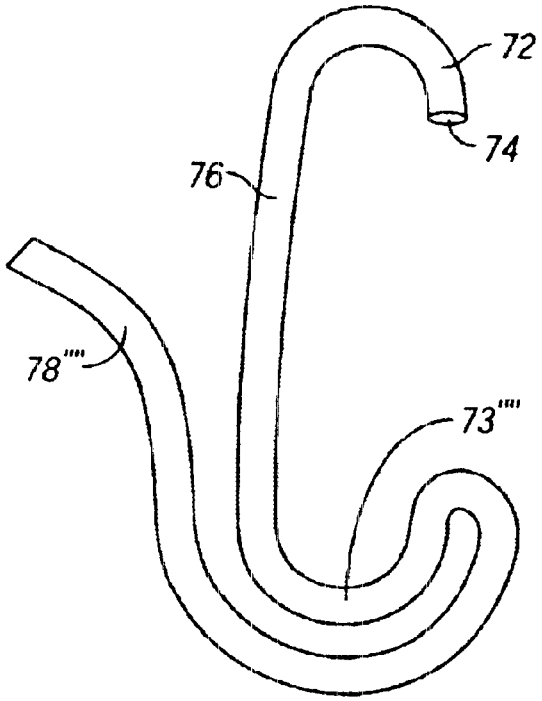

The small extension may protrude from the body portion of the fastening clip as shown previously, or from one of the legs of the fastening clip. Referring now to FIG. 9A, the small extension 78" is located on leg 73". In FIG. 9B, the small extension 78'" is also located on leg 73'", but is formed by bending the wire forming leg 73'". In FIG. 9C, the wire forming leg 73"" is bent back along leg 73"" and along a portion of the body portion 76 and then the small extension 78"" extends outwardly similar to the small extension 78 in FIG. 6.

The fastening clips 70 are constructed according to their intended purpose. For example, when needed to secure concrete reinforcement members together, the fastening clips 70 would be constructed of heavy gage wire (i.e., 12 to 14 gage). Similarly, the length of the fastening clips 70 is solely dependent upon the intended use. For securing concrete reinforcement members, a suitable length would be approximately 4 to 6 inches. Additionally, the radius of the curvature of the fastener clip legs may be the same or different from each other. However, one skilled in the art would recognize that depending upon the intended use of the fastening clips 70 there are any number of combinations of materials and sizes which could be used and remain within the purview of the invention.

Figure 10:
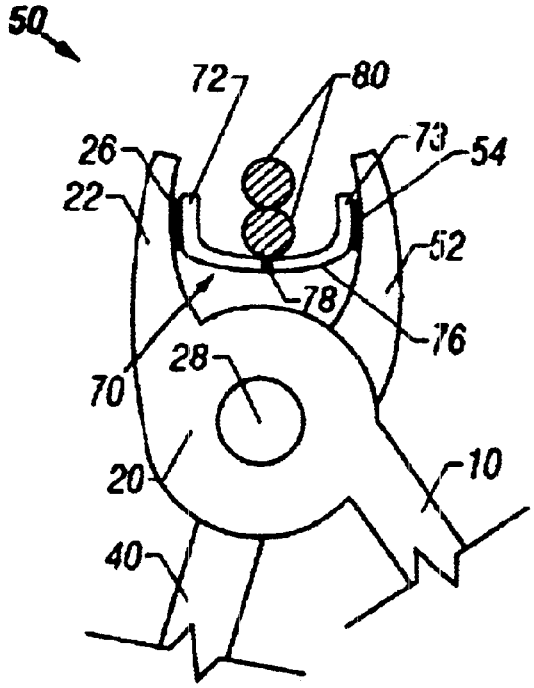
FIG. 10 is side view of a preferred embodiment of the fastener clip pliers and fastener clip. The fastener clip pliers are in an open position.
Figure 11:
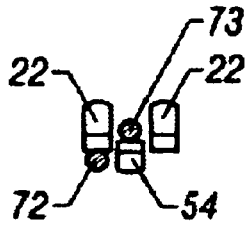

Referring now to FIGS. 10–13, the preferred method of use of the present invention will be described. Initially, the fastening clip 70 is positioned below the reinforcement bars 80 to be secured. The fastening clip 70 is positioned and held in place by gripping and maneuvering the small extension 78 which is affixed to the body portion 76 of the fastening clip. As best illustrated in FIGS. 10–11, while the fastening clip 70 is being held in place, the fastener clip pliers 1 are held in an open position and placed around the legs 72, 73 of the fastening clip 1. The fastener clip pliers 1 are placed around the fastening clip 70 such that the legs 72, 73 are in alignment with one of the first prongs 22 and the second prong 52. It should be noted that any of the first prongs 22 could be used to advantage. The selection of which first prong 22 to use is dependent upon the angle of use and the user's preference.

After the legs 72, 73 of the fastening clip 70 are properly aligned with the prongs of the fastener clip pliers 1, the lower handle 10 and the upper handle 40 are pivoted until the legs 72, 73 of the fastening clip 70 are gripped by the grooves 26, 54 of the selected first prong 22 and the second prong 52. If the alternate embodiment shown in FIG. 1A is used, the legs 72, 73 of the fastening clip 70 are fitted within the grooves 27, 55 of the selected first prong 22 and second prong 52. Once the fastening clip 70 is securely gripped, it is no longer necessary to use the small extension 78 to hold the fastening clip 70 in place.

Figure 12:
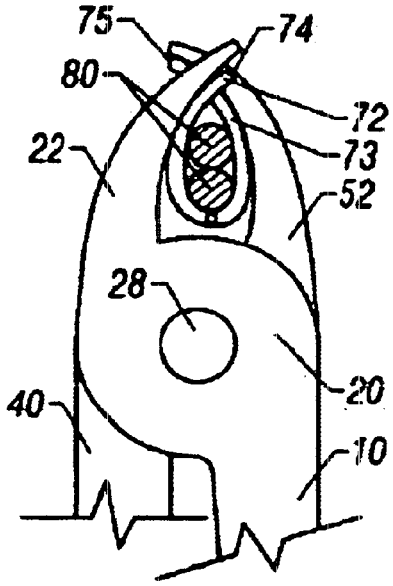
FIG. 12 is side view of a preferred embodiment of the fastener clip pliers and fastener clip. The fastener clip pliers are in a closed position.
Figure 13:
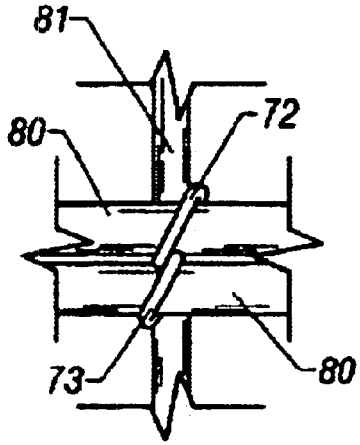
FIG. 13 is top view of a preferred embodiment of the fastener clip being used to secure a reinforcing member.

The lower handle 10 and the upper handle 40 are further pivoted until the fastener clip pliers 1 are in a closed position a shown in FIG. 12. In the closed position, the second prong 52 is forced into the intermediate slot 24 defined by the first prongs 22. As a consequence, the legs 72, 73 of the fastening clip 70 are tied around the reinforcement members 80 in an overlapping fashion. FIG. 13 shows a top view of the fastening clip 70 tied around the reinforcement members 80 and a crossing member 81. As illustrated, the legs 72, 73 are overlapping but remain substantially parallel to each other.

Although described in terms of the preferred embodiments shown in the figures, those skilled in the art who have the benefit of this disclosure will recognize that changes can be made to the individual component parts thereof which do not change the manner in which those components function to achieve their intended result. All such changes are intended to fall within the scope of the following non-limiting claims.

What is claimed is:

1. In combination with reinforcement steel members, a fastening clip for securing together at least two reinforcement steel members, the fastening clip comprising:

a first leg;

a second leg;

a body portion connecting the first leg to the second leg; and a handle means comprising a single small extension protruding from the body portion or either the first or second leg for use as a handle for manipulation and positioning of the fastening clip prior to securing the clip in place, wherein in an open position the first and second legs are spaced from each other defining an opening to allow manual positioning of the clip about the at least two reinforcement steel members using the handle means and in a closed position the first and second legs overlap each other securing the clip in place about the at least two reinforcement steel members, thereby securing the at least two steel reinforcement members to each other.

2. The fastening clip as in claim 1, wherein the first leg is curved inwardly to facilitate securing the fastening clip to the reinforcement steel members.

3. The fastening clip as in claim 1, wherein the second leg is curved inwardly to facilitate securing the fastening clip to the reinforcement steel members.

4. The fastening clip as in claim 1, wherein the first leg and the second leg are bent in opposite directions from a plane parallel with the body portion.

5. The fastening clip as in claim 1, wherein the small extension protrudes from the body portion.

6. The fastening clip as in claim 1, wherein the small extension protrudes from the second leg.

7. In combination with reinforcement steel members, a fastening clip for securing together at least two reinforcement steel members, the fastening clip comprising:

a first leg having a first end, the first leg curved inwardly along its length to facilitate securing of the fastening clip over the reinforcement steel members;

a second leg having a second end, the second leg curved inwardly along its length to facilitate securing of the fastening clip over the reinforcement steel members;

a body portion connecting the first leg to the second leg such that the first leg and second leg are bent away in opposite directions from a plane parallel with the body portion to prevent the first and second ends from abutting when the fastening clip is secured over the at least two reinforcement steel members; and a handle means comprising a single small extension protruding from the body portion or from either the first or second leg for use as a handle for placing and holding the fastening clip around the reinforcement steel members prior to securing the clip in place, wherein in an open position the first and second ends are spaced from each other defining an opening to allow manual positioning of the clip about the at least two reinforcement steel members using the handle means and in a closed position the first and second legs overlap each other securing the clip in place about the at least two reinforcement steel members, thereby securing the at least two steel reinforcement members to each other.

8. The fastening clip as in claim 7, wherein the body portion, first leg and second leg form a C-shape.

9. The fastening clip as in claim 7, wherein the body portion, first leg and second leg form a U-shape.

10. The fastening clip as in claim 7, wherein the body portion, first leg and second leg form a loop shape.

11. The fastening clip as in claim 7, wherein the small extension protrudes from the body portion.

12. The fastening clip as in claim 7, wherein the small extension protrudes from the second leg.

* * * * *